US007093385B2

(12) United States Patent
Engler

(10) Patent No.: US 7,093,385 B2
(45) Date of Patent: Aug. 22, 2006

(54) ANTENNA BALL ASSEMBLY AND METHOD OF USE

(76) Inventor: Dennis D. Engler, 2572 Quail Run Dr., Plainfield, IL (US) 60544

( * ) Notice: Subject to any disclaimer, the term of this patent is extended or adjusted under 35 U.S.C. 154(b) by 0 days.

(21) Appl. No.: 10/957,597

(22) Filed: Oct. 5, 2004

(65) Prior Publication Data

US 2006/0070283 A1 Apr. 6, 2006

(51) Int. Cl.
*G09F 21/04* (2006.01)

(52) U.S. Cl. ..... 40/591; 40/592; 428/31; 24/129 B

(58) Field of Classification Search ..... 40/591, 40/592, 412, 413, 415; 116/50, 35 R, 173; 446/30; 428/31; 24/129 B
See application file for complete search history.

(56) References Cited

U.S. PATENT DOCUMENTS

| | | | | | |
|---|---|---|---|---|---|
| 1,441,261 | A * | 1/1923 | Ackman | ..... | 40/413 |
| 1,524,313 | A * | 1/1925 | Rumohr | ..... | 40/413 |
| 1,531,566 | A * | 3/1925 | Moiseve et al. | ..... | 40/413 |
| 3,359,670 | A * | 12/1967 | Pyc et al. | ..... | 40/591 |
| 3,557,477 | A * | 1/1971 | Trent et al. | ..... | 40/413 |
| 5,027,539 | A * | 7/1991 | Orsini | ..... | 40/415 |
| 5,665,438 | A * | 9/1997 | Lee et al. | ..... | 428/31 |
| 6,063,459 | A * | 5/2000 | Velte | ..... | 428/31 |
| 6,278,408 | B1 * | 8/2001 | Segovia, Jr. | ..... | 343/715 |
| 6,598,556 | B1 * | 7/2003 | Peters | ..... | 116/50 |
| 2003/0019139 | A1 * | 1/2003 | Cook | ..... | 40/591 |

* cited by examiner

*Primary Examiner*—Gary C. Hoge
(74) *Attorney, Agent, or Firm*—Breiner & Breiner, L.L.C.

(57) ABSTRACT

An antenna ball assembly which can display a message such as an advertisement or the like thereon and a method of use is disclosed. The antenna ball assembly has a body having at least one inclined surface and a passage therethrough, a tail attached to the body and at least one flexible stopper. A flexible stopper is preferably positioned at each of the bottom and the top of an antenna. The body is positioned between the stoppers on the antenna with the antenna passing through the passage in the body. The inclined surface is preferably two inclined body extension members or an inclined flat face. The two extension members form an angle between the body and an upper portion of the extension member of from about 30° to about 40°. The inclined flat face forms an angle between the inclined flat face and the vertical axis from about 30° to about 40°. The angle controls the movement of the body, thereby allowing the body to move up the antenna as the antenna moves, such as when attached to a car.

25 Claims, 2 Drawing Sheets

10
30
26
20
W
18
MESSAGE
25
16
30

10'
30
20'
26
18
W
MESSAGE
25'
16'
30

10
26
17
16
20
A
24
16
19
MESSAGE
18

10'
26'
24'

20'
18
A'
16'

ANTENNA BALL ASSEMBLY AND METHOD OF USE

FIELD OF INVENTION

The present invention relates to an antenna ball assembly with a body which may display an advertisement, streamer or the like thereon, and a method of use thereof. The antenna ball assembly preferably is positioned on an antenna such that the antenna ball body moves up and down the antenna based on motion of the antenna, thereby displaying the advertisement, streamer or the like thereon.

BACKGROUND OF THE INVENTION

People use various modes of advertisement for promoting their business or sponsored activities. Traditional forms of advertising include word-of-mouth, placing an advertisement in a newspaper, placing an advertisement in a magazine and/or placing an advertisement on a billboard. However, traditional modes of advertising may not reach as broad of a group of people as desired or a particular targeted group of people by the person placing the advertisement. As such, people are developing new modes of advertising to reach a broad or targeted audience which requires less effort on the part of the audience to view the advertisement.

Accordingly, new modes of advertising are desired.

Further, to show support of a sporting team, school, or the like, streamers of representative colors or pennants with names as desired may be flown on a vehicle, in particular as the vehicle proceeds to an event for the team, school or the like. Accordingly, new and interesting display means are sought.

OBJECTS AND SUMMARY OF THE INVENTION

The present invention relates to an antenna ball assembly which displays an advertisement, streamer or the like thereon and a method of use thereof. The antenna ball assembly preferably is positioned on an antenna such that the antenna ball body moves up and down the antenna as the antenna moves, thereby displaying the advertisement or the like. The assembly may be used with an antenna or rod-like member attached to any article capable of sustained motion, e.g., a car, a bike, or other vehicle. For convenience of discussion the invention will be described in relation to use with a car antenna.

The antenna ball assembly preferably comprises an antenna ball body having at least one inclined surface and a passage extending therethrough, a tail attached to the antenna ball body and at least one flexible stopper. The antenna ball body is placed on the antenna with the antenna passing through the passage therein. A flexible stopper is then placed on the car antenna to keep the antenna ball body from coming off of the car antenna when in use. Another flexible stopper may be positioned at the bottom of the car antenna to provide initial lift to the ball body which serves to decrease the amount of motion required before movement of the body along the antenna.

The antenna ball body may be preferably a substantially spherical shape. The at least one inclined surface is preferably two inclined body extension members or an inclined flat face. The two inclined body extension members are angled such that the angle between each inclined body extension member and the upper portion of the antenna ball body is preferably from about 30° to from about 40°. This angle serves to control the movement of the antenna ball body. The angle allows the antenna ball body to move or fly up the car antenna as the car with the antenna moves. The body extension members can be in a wing-like configuration.

When the body is provided with an inclined flat face, the inclined flat face is angled such that the angle between the lower portion of the inclined flat face and the vertical axis is from about 30° to from about 40°. This angle serves to control the movement of the antenna ball body. The angle allows the antenna ball body to move or fly up the car antenna as the car with the antenna moves.

The tail or the length of the tail is advantageously present in that the tail acts to keep the antenna ball body straight and facing into the wind. The tail is to provide for a space for a message to be printed thereon or attached thereto.

BRIEF DESCRIPTION OF THE DRAWINGS

Referring now to the drawings.

DETAILED DESCRIPTION OF THE PREFERRED EMBODIMENTS

The present invention relates to an antenna ball assembly 10,10' which displays an advertisement or the like thereon and a method of use thereof. The antenna ball assembly 10,10' preferably is positioned on a car antenna such that the antenna ball body 20,20' moves up and down the car antenna as the car moves, thereby displaying the advertisement thereon.

Figure 1:
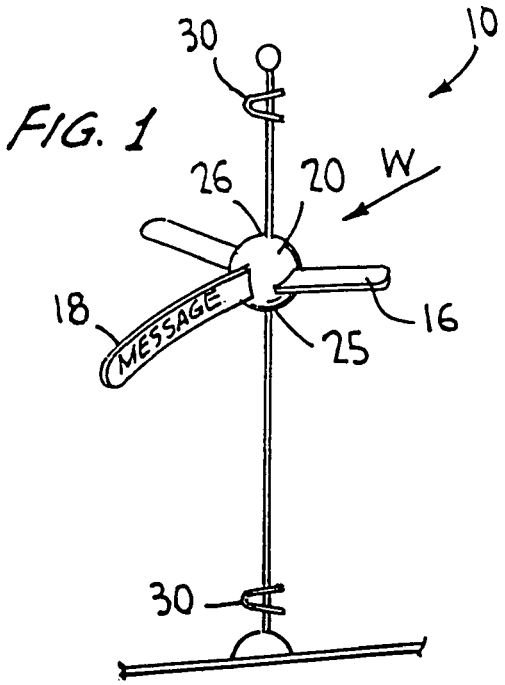
FIG. 1 is a perspective view of a preferred embodiment of the antenna ball assembly of the present invention in use on a car antenna.
Figure 2:
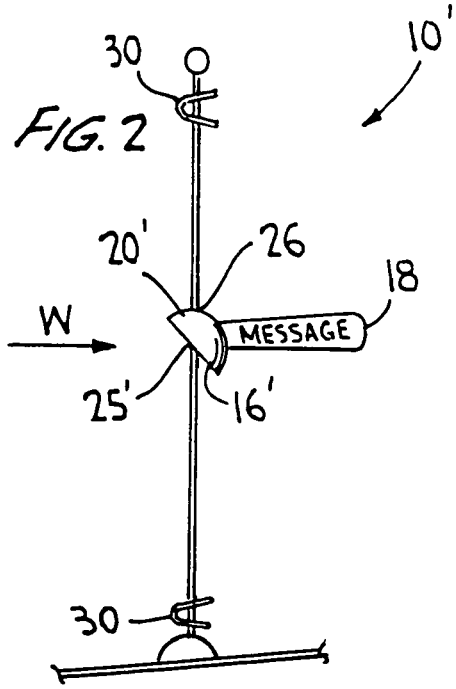
FIG. 2 is a perspective view of another preferred embodiment of the antenna ball assembly of the present invention in use on a car antenna.

Referring to FIGS. 1–7, the antenna ball assembly 10,10' preferably comprises an antenna ball body 20,20' having at least one inclined surface and a passage 24,24' therethrough, a tail 18 attached to the antenna ball body 20,20' and preferably at least one flexible stopper 30. As shown in FIGS. 1 and 2, the antenna ball body 20,20' is placed on the antenna with the antenna passing through the passage 24,24' by passing through a first end 25,25' of the passage 24,24' and out a second end 26,26' of the passage 24,24'. A first flexible stopper 30 is then placed on the car antenna to keep the antenna ball body 20,20' from coming off of the car antenna when in use. A second flexible stopper 30 may be positioned at the bottom of a car antenna. The second stopper maintains the body in a lift position.

Figure 3:
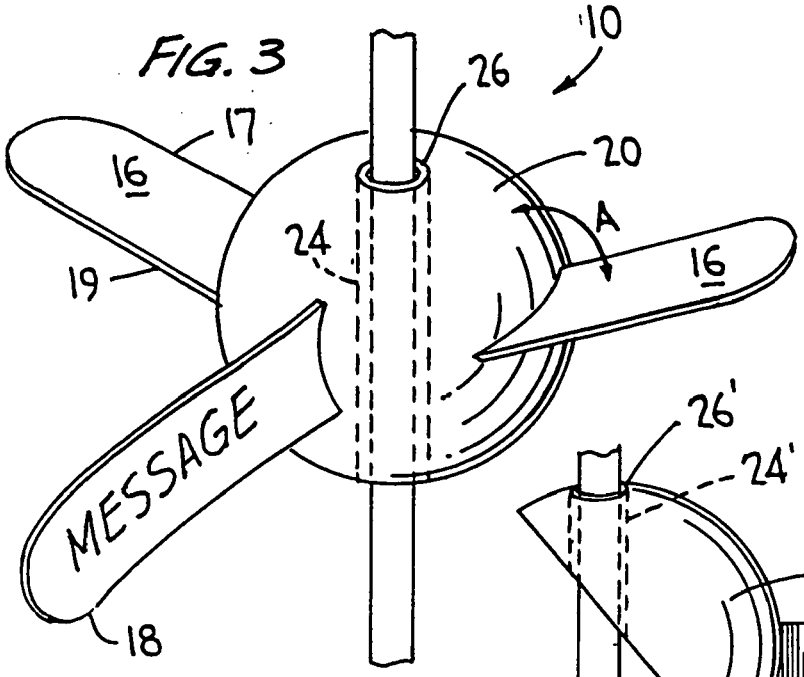
FIG. 3 is a back perspective view of the antenna ball body of the antenna ball assembly of FIG. 1.

The antenna ball body 20,20' may preferably be a substantially spherical shape having at least one inclined surface. The at least one inclined surface and the angle A,A' thereof is critical to the function of the antenna ball assembly 10,10'. Specifically, the at least one inclined surface and angle A,A' thereof allows the ball body 20,20', to move or fly up the car antenna as the car with the antenna moves. In one preferred embodiment, the passage 24 is operatively positioned substantially through the center of the antenna ball body 20, as shown in FIGS. 1 and 3. The passage 24 is of a size sufficient to fit over a car antenna or other rod-like extension on which the body 20 is to be positioned.

In the preferred embodiment of FIGS. 1 and 3, the at least one inclined surface is an inclined body extension member 16. More preferably, the at least one inclined surface comprises two inclined body extension members 16, as shown in FIGS. 1 and 3, which may be attached to or integral with the body 20. The two inclined extension members 16 preferably operatively extend from the antenna ball body 20 at a location which is substantially perpendicular to the passage 24 at or near the horizontal circumference of the antenna ball body 20. Preferably, the two inclined extension members 16 are also operatively positioned substantially opposite from each other around the circumference of the antenna ball body 20.

As shown in FIG. 3, the two inclined body extension members 16 preferably extend from the body 20 to provide an angle A along the width of the antenna ball body 20 and in a range from about 30° to from about 40° measured from the upper portion of the antenna ball body 20. More preferably, the two inclined body extension members 16 are preferably positioned at an angle A along the width of the antenna ball body 20 from about 33° to from about 38° measured from the upper portion of the antenna ball body 20, and most preferably positioned at about 35° measured from the upper portion of the antenna ball body 20. This angle A is controlling in the function of the antenna ball body 20. This angle A allows the antenna ball body 20 to move or fly up the car antenna as the car with the antenna moves. With other angles, the antenna ball body 20 does not move smoothly up the antenna, and/or may not move completely to the top of the antenna where the stopper 30 is located, and/or may have difficulty in starting to move from the base of the antenna when the car moves.

The position of the two inclined extension members 16 along the length of the body 20 as viewed from the front of the antenna ball body 20 is not critical to the operation of the antenna ball assembly 10. This aspect is purely aesthetic. For example, the extension members 16 may be positioned to have an upward tilt, i.e., the forward edge 17 of the extension member 16 being higher than the backward edge 19 of the extension member 16.

The tail 18 may be located in any suitable position on the antenna ball body 20. However, in the embodiment of FIGS. 1 and 3 having two inclined body extension members, the tail 18 may preferably be substantially centered between and planar to the two inclined body extension members 16. The tail or the length of the tail is advantageously present in that the tail acts to keep the antenna ball body straight and facing into the wind. The tail 18 can act as a streamer or message holder itself or have an advertisement, streamer or the like attached thereto.

Figure 4:
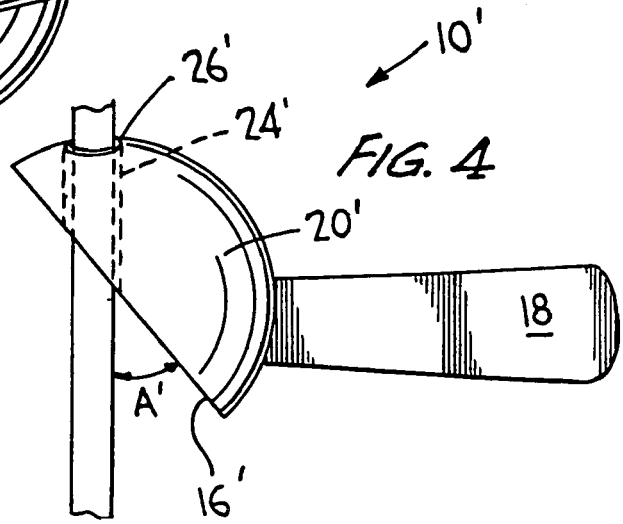
FIG. 4 is a side view of the antenna ball body of the antenna ball assembly of FIG. 2.
Figure 5:
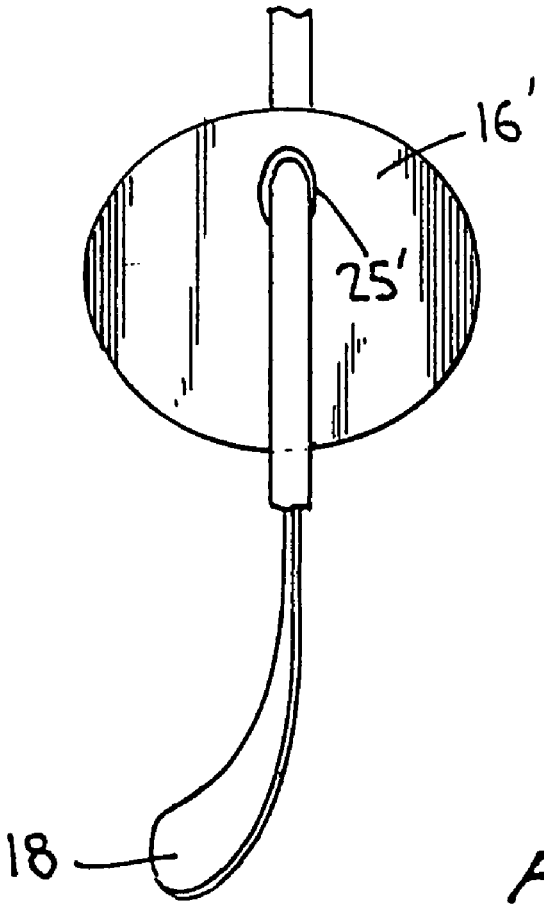
FIG. 5 is a front view of the inclined flat face of the antenna ball body of FIG. 4.

In another preferred embodiment as shown in FIGS. 2, 4 and 5, the passage 24' is also operatively positioned through the antenna ball body 20'. The passage 24' is of a size sufficient to fit over a car antenna or other rod-like extension on which it may be used. In this embodiment, the at least one inclined surface is an inclined flat face 16', as shown in FIGS. 2, 4 and 5. The angle A' of the inclined flat face 16' between the lower portion of the inclined flat face 16' and the car antenna, i.e., vertical axis, is important to the operation of the antenna ball assembly 10'. This angle A' serves to control movement of the antenna ball body 20' along the antenna. This angle A' allows the antenna ball body 20' to move or fly up the car antenna as the car with the antenna moves. The angle A', i.e., the angle between the lower portion of the inclined flat face 16' and the car antenna, i.e., vertical axis, is preferably in a range from about 30° to from about 40°, more preferably from about 33° to from about 38° and most preferably at about 35°. With other angles, the antenna ball body 20' does not move smoothly up the antenna, and/or may not move completely to the top of the antenna where the stopper 30 is positioned, and/or may have difficulty in starting to move from the base of the antenna when the car moves.

Based upon the angle of the inclined flat face 16' of the antenna ball body 20', the antenna ball body 20' is a substantially half-sphere shape and end 25' of passage 24' which is in the inclined flat face 16' is cut at an angle, as shown in FIG. 5.

In this embodiment, the tail 18 may preferably be substantially centered on the antenna ball body 20' substantially opposite from the inclined flat face. However, the tail 18 may be located in any suitable position on the antenna ball body 20'. The tail or the length of the tail is advantageously present in that the tail acts to keep the antenna ball body straight and facing into the wind. The tail, as described above, allows for placement of a message, advertisement or the like to be placed thereon or attached thereto.

Figure 7:
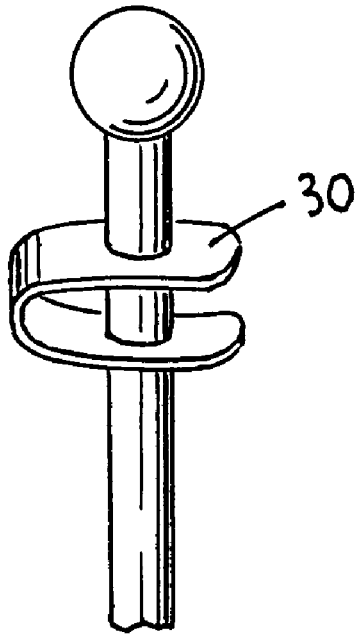
FIG. 7 is a perspective view of the flexible stopper of FIG. 6 of the antenna ball assembly of FIGS. 1 and 2 in use on a car antenna.
Figure 6:
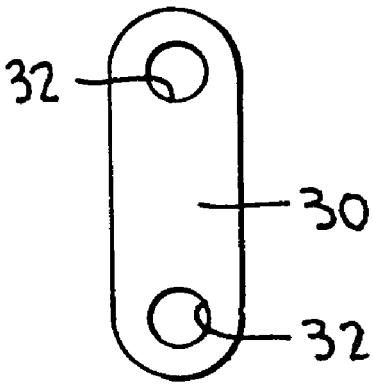
FIG. 6 is a planar view of a flexible stopper of the antenna ball assembly of FIGS. 1 and 2.

The flexible stopper 30 may be any suitable stopper. However, the flexible stopper 30 preferably has an oblong shape and has an opening 32 in each end, as shown in FIG. 6. The flexible stopper 30 preferably flexes to form a substantially C-shape when in position on an antenna, as shown in FIG. 7. This shape of the flexible stopper 30 is particularly advantageous in the functioning of the antenna ball assembly 10,10' by allowing continuous movement of the antenna ball body 20,20'. Particularly, when the antenna ball body 20,20' moves up the antenna and comes in contact with the flexible stopper 30, the antenna ball body 20,20' has a bobbing motion against the stopper 30. As such, the antenna ball body 20,20' continues to move and does not remain rigid on the antenna, which provides a more eye-catching effect for any passersby. While the preferred embodiment of the flexible stopper 30 has been described, any suitable stopper, such as a soft body on the top of the antenna, may be used. Additionally, the stopper may be made of any suitable material including, but not limited to, rubber and plastic.

The weight of the antenna ball body 20,20' is not critical to the function of the antenna ball assembly 10,10'. The antenna ball body 20,20' may preferably be made from a lightweight material such as, but not limited to, foam, rubber or plastic. The two inclined extension members 16 of the antenna ball body 20 may preferably be made from any suitable material such as, but not limited to, plastic, foam, rubber or the like sufficiently rigid to hold its shape. The tail 18 of the antennal ball body 20,20' may preferably be made from a flexible material such as, but not limited to, rubber, plastic, foam or the like.

The exemplary embodiments herein disclosed are not intended to be exhaustive or to unnecessarily limit the scope of the invention. The exemplary embodiments were chosen and described in order to explain the principles of the present invention so that others skilled in the art may practice the invention. As will be apparent to one skilled in the art, various modifications can be made within the scope of the aforesaid description. Such modifications being within the ability of one skilled in the art form a part of the present invention and are embraced by the appended claims.

The invention claimed is:

1. An antenna ball assembly comprising:

an antenna ball body of a semi-spherical shape having at least one inclined surface, which includes an inclined flat face of said ball body, and a passage extending through the body;

a tail extending from said antenna ball body, wherein said tail is operatively positioned on said antenna ball body to keep said inclined flat face facing into a direction of wind when said body is positioned on an antenna; and at least one stopper;

wherein said passage is operatively positioned through said antenna ball body to maintain said inclined flat face on an angle to said antenna when said body is positioned on an said antenna, wherein said angle controls movement of said antenna ball body, and wherein said at least one inclined surface is spaced apart from said tail.

2. The antenna ball assembly of claim 1, wherein said angle is from about 30° to from about 40°.

3. The antenna ball assembly of claim 1, wherein said at least one stopper is flexible and flat having a first end and a second end, wherein said first end and said second end each have an opening therein, wherein each opening is of a size sufficient to fit on said antenna.

4. The antenna ball assembly of claim 3, wherein said at least one stopper flexes to form a substantially C-shape when positioned on said antenna.

5. The antenna ball assembly of claim 1, wherein said assembly contains two of said at least one stopper, one for placement beneath said body and one for placement above said body.

6. The antenna ball assembly of claim 1, wherein said antenna ball body is made of foam, rubber or plastic.

7. The antenna ball assembly of claim 1, wherein said tail is made of rubber, foam or plastic.

8. An antenna ball assembly comprising:

an antenna ball body of a substantially spherical shape having at least two inclined surfaces which each provides in conjunction with another surface an angle from about 30° to about 40° and a passage extending through the body;

a tail extending from said antenna ball body, wherein said tail is operatively positioned on said antenna ball body to keep said antenna ball body facing into a direction of wind when said body is positioned on an antenna; and at least one stopper;

wherein said passage is operatively positioned through said antenna ball body to maintain said at least two inclined surfaces when said body is positioned on said antenna, wherein said inclined surface has an angle which controls movement of said antenna ball body, and wherein said at least one inclined surface is spaced apart from said tail.

9. The antenna ball assembly of claim 8, wherein said at least two inclined surfaces comprise two inclined body extension members extending from said antenna ball body.

10. The antenna ball assembly of claim 9, wherein said two inclined body extension members are operatively positioned substantially perpendicular to said passage at or near a horizontal circumference of said antenna ball body.

11. The antenna ball assembly of claim 10, wherein said two inclined body extension members are operatively positioned substantially opposite from each other around said horizontal circumference of said antenna ball body.

12. The antenna ball assembly of claim 9, wherein said two inclined body extension members are operatively positioned substantially opposite from each other around a horizontal circumference of said antenna ball body.

13. The antenna ball assembly of claim 9, wherein said two inclined body extension members are made of plastic, foam or rubber.

14. A method of displaying an advertisement on an antenna comprising:

positioning an antenna ball assembly as claimed in claim 1 on said antenna, wherein said antenna ball assembly displays an advertisement on said tail or attached to said tail.

15. The method of displaying an advertisement on an antenna of claim 14, wherein said positioning of said antenna ball assembly on said antenna comprises:

positioning a first stopper at or near a base of said antenna;

positioning said antenna ball body on said antenna; and positioning a second stopper at or near a top of said antenna, wherein said second stopper maintains said antenna ball body on said antenna.

16. The method of displaying an advertisement on an antenna of claim 15, wherein each of said first stopper and said second stopper is flexible and flat having a first end and a second end, wherein said first end and said second end each have an opening therein, wherein each opening is of a size sufficient to fit on said antenna.

17. The method of displaying an advertisement on an antenna of claim 16, wherein each of said first stopper and said second stopper forms a substantially C-shape when positioned on said antenna.

18. The method of displaying an advertisement on an antenna of claim 14, wherein said angle is from about 30° to from about 40°.

19. A method of displaying an advertisement on an antenna comprising:

positioning an antenna ball assembly as claimed in claim 8 on said antenna, wherein said antenna ball assembly displays an advertisement on said tail or attached to said tail.

20. The method of displaying an advertisement on an antenna of claim 19, wherein said at least two inclined surfaces comprise two inclined body extension members extending from said antenna ball body.

21. The method of displaying an advertisement on an antenna of claim 20, wherein said two inclined body extension members are operatively positioned substantially perpendicular to said passage at or near a horizontal circumference of said antenna ball body.

22. The method of displaying an advertisement on an antenna of claim 21, wherein said two inclined body extension members are operatively positioned substantially opposite from each other around said horizontal circumference of said antenna ball body.

23. The method of displaying an advertisement on an antenna of claim 19, wherein said positioning of said antenna ball assembly on said antenna comprises:

positioning a first stopper at or near a base of said antenna;

positioning said antenna ball body on said antenna; and positioning a second stopper at or near a top of said antenna, wherein said second stopper maintains said antenna ball body on said antenna.

24. The method of displaying an advertisement on an antenna of claim 23, wherein each of said first stopper and said second stopper is flexible and flat having a first end and a second end, wherein said first end and said second end each have an opening therein, wherein each opening is of a size sufficient to fit on said antenna.

25. The method of displaying an advertisement on an antenna of claim 24, wherein each of said first stopper and said second stopper forms a substantially C-shape when positioned on said antenna.

* * * * *